United States Patent [19]

Mansouri et al.

[11] Patent Number: 4,587,681

[45] Date of Patent: May 13, 1986

[54] POWER OPERATED SEPARABLE BEDS AND SUPPORT THEREFOR

[76] Inventors: Mansour N. Mansouri, 1717 Sanysidro Dr., Beverly Hills, Calif. 91210; Masoud N. Mansouri, 1110 N. Bundy Dr., Los Angeles, Calif. 90049; Kambiz Imani, 11667 Ohio Ave., Los Angeles, Calif. 90025

[21] Appl. No.: 733,884

[22] Filed: May 14, 1985

Related U.S. Application Data

[62] Division of Ser. No. 568,347, Jan. 5, 1984, Pat. No. 4,524,471.

[51] Int. Cl.[4] ..... A47C 19/00

[52] U.S. Cl. ..... 5/8

[58] Field of Search ..... 5/8, 511, 510, 18 R, 5/18 B, 1

[56] References Cited

U.S. PATENT DOCUMENTS

| | | | |
|---|---|---|---|
| 544,630 | 8/1895 | Scherer | 5/8 |
| 675,519 | 6/1901 | McDonnell | 5/182 |
| 866,954 | 9/1907 | Nehr | 5/8 |
| 1,040,799 | 10/1912 | Skeffington | 5/462 |
| 1,323,229 | 11/1919 | Borhauer | 5/8 |
| 1,350,327 | 8/1920 | Moir | 5/8 |
| 2,215,636 | 9/1940 | Comper | 5/69 |
| 2,644,168 | 7/1953 | Sandow | 5/8 |

*Primary Examiner*—Alexander Grosz

*Attorney, Agent, or Firm*—William H. Maxwell

[57] ABSTRACT

A composite bedding unit comprised of adjoining single bed units adapted to be juxtaposed in the form of double bedding and separable along a median line dividing the sleeping areas of two retiring individuals having distinct sleeping requirements when lying together, the two bed units being carried by a common support and mechanized to be separated from said median line adjacency in the form of single bedding.

7 Claims, 8 Drawing Figures

B1
B2
12
11
10
28
29
35
39
37
6
6
a
21
19
20
18
25

B1
12
H
30
31
27
35
18
15
17
19
20
37
45
46
42
41
40
M
25
13
F
21
16
28

FIG. 6.
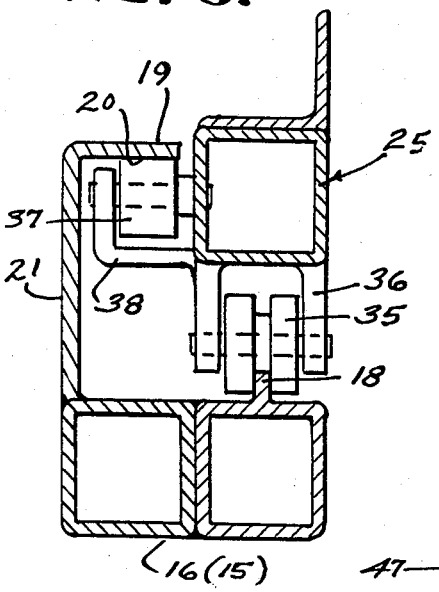
FIG. 8.
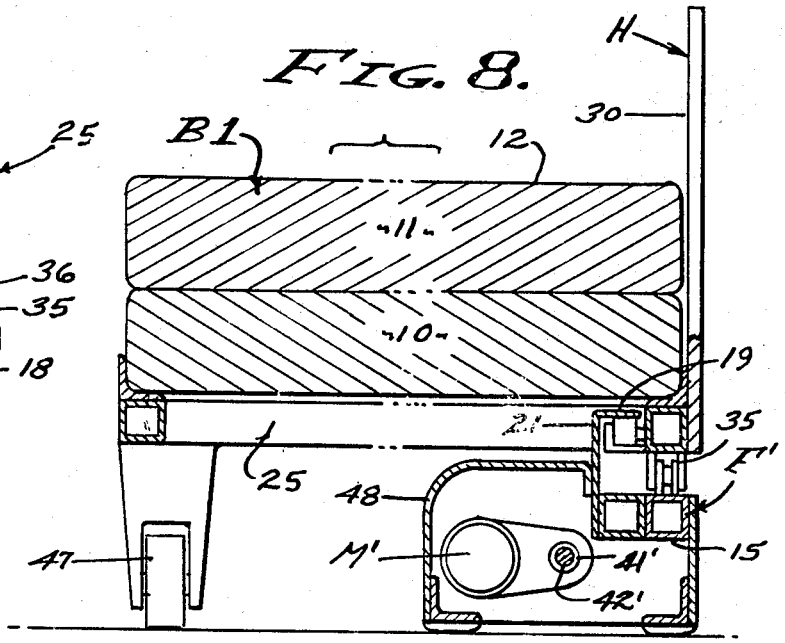
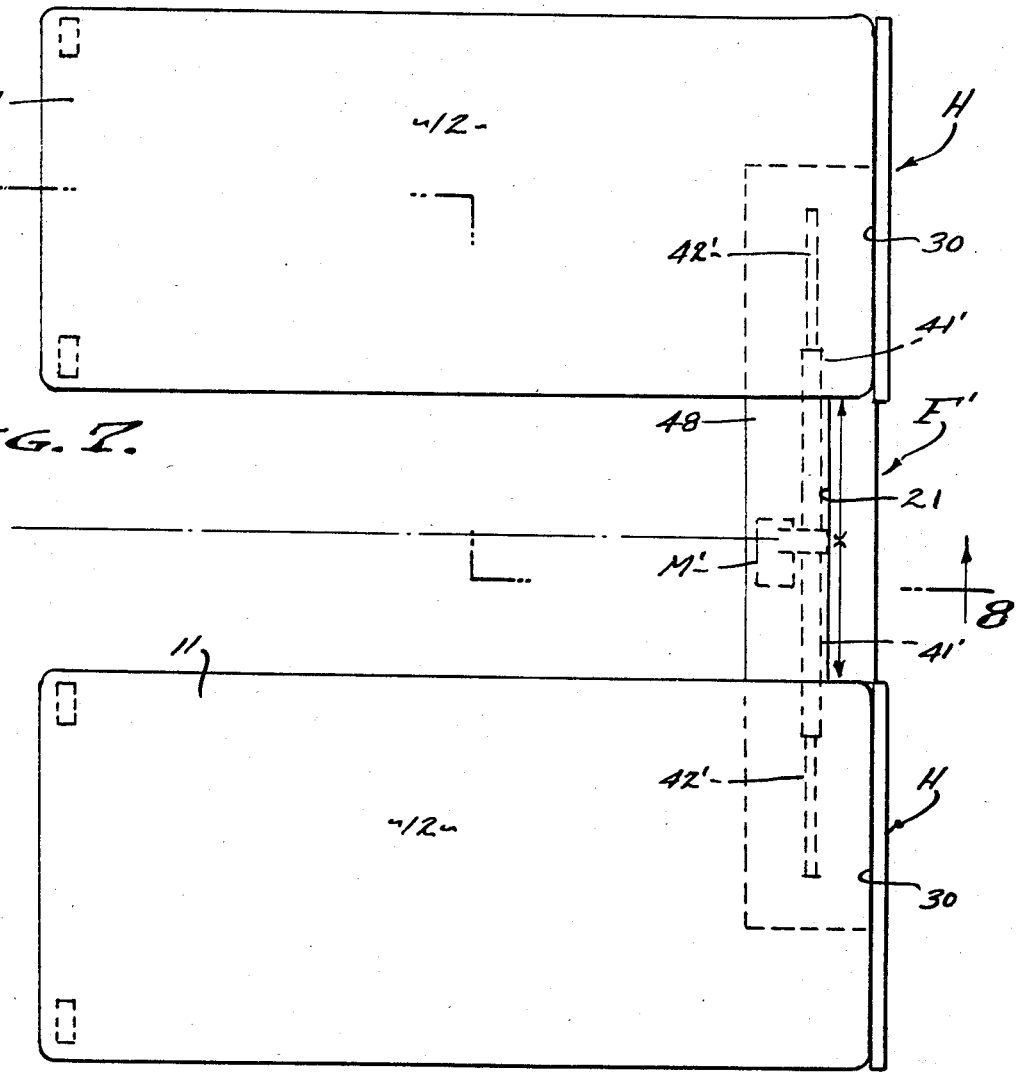
FIG. 7.

POWER OPERATED SEPARABLE BEDS AND SUPPORT THEREFOR

This is a division of application Ser. No. 06/568,347 filed Jan. 5, 1984, entitled POWER OPERATED SEPARABLE BEDS AND SUPPORT THEREFOR Now U.S. Pat. No. 4,524,471.

BACKGROUND

Bedding is comprised generally of a mattress supported upon springs by a bedstead and over which sheets and blankets are drawn so as to cover one or more persons reclining thereon. Beds vary in size or capacity and are referred to as "single" or "double" beds, there being various sizes thereof. It is customary for two persons or individuals to retire upon one double bed, or so-called "Queen Size" or "King Size" bed, to share the same bed springs and mattress. It is also customary for two persons or individuals to retire upon separate single beds, so that one or the other is not disturbed when sleeping. Although humans are biologically the same with respect to functional requirements and body temperatures, there are differences of habit, likes and dislikes, brought about by sex, body weight, and idiosyncrasies. Accordingly, one person may be compatable with another person to a print, but disturbed by the sleeping habits of the other person, or simply unable to cope with the transfer of body heat and breathing, or there can be a great difference in the preference of cover weight and capture of heat.

It is a general object of this invention to provide for the selective positioning of separate beds by two individuals initially retiring together. In practice, each individual selects the time and closeness of bed adjacency or separation according to his or her choice, personal requirements and desires. In accordance with this invention, there are adjoining single beds carried by a common support and separable from adjacency along a median line extending from head to foot of the bed.

It is the comfort of two individuals retiring together side by side with which this invention is concerned. The continued presence or closeness to another person can be uncomfortable and disconcerting to otherwise compatable individuals, all because of their particular requirements. For example, one person may require a heavier blanket than another, causing the other person to perspire while the one person is comfortably warm, or permitting the one person to chill while the other is kept warm. Generally, a female will require heavier blanketing than a male, and corpulent persons require less blanketing; but all in degrees of preference. Also, a person may disturb another by movements such as thrashing about, or one person may be ill which presents the problem of contamination. Therefore, it is an object of this invention to provide for selective and variable separation by either person without disturbing the other, the beds being mechanically separated from a median line by power means as will be described.

It is an object of this invention to provide a common support for separable beds that are adjacently related as hereinabove described. It is a bedding unit that is provided, wherein a pair of single beds or the like are carried by a common base which they coextensively overlie when brought into adjacency and from which they cantilever when they are separated.

It is also an object of this invention to prevent overturning when in the cantilevered condition, whereby the individual beds are stable even when a substantial portion thereof is projected laterally beyond the support of the base. It is still another object of this invention to provide individual and or dual control over the adjacency and/or separation conditions whereby either person can operate one or both beds into the desired condition, all as circumstances require.

It is a further object of this invention to provide stability at the headboard of a bedding unit of the type under consideration, wherein the headboard carries and guides the two separable single beds and incorporates drive means therein for power positioning thereof. In a second form of this invention, the foot of each of the two beds glides directly upon and over the floor, being guided entirely by the headboard frame or base. Accordingly, the space between the beds, when separated, is unobstructed by any mechanism. However, in the event that a floor covering or carpet is too dense, then a track or the like can be employed for support and free running of the beds at the foot thereof respectively.

SUMMARY OF THE INVENTION

A base frame is supported upon the bedroom floor in the usual manner, with or without casters. At the head and foot of two like single spring and mattress units, there is transverse rolling support, the single bed units being guided by one or both head and foot portion of the base frame, and in one embodiment the headboard alone guides the two single bed units. A feature of the guided support is the stability which it affords, and all of which is such as to facilitate assembly and disassembly. Conditioning of the single bed units is motorized for individual movements of either single bed unit by its occupant, or in unison if so desired. Motorization is disposed between the base frame and each single bed unit, and in the preferred embodiment said motorization is at the headboard that guides the single bed units, in which case the floor space between is unobstructed when separation occurs. The two single bed units are conventional in every respect, and they are preferably identical so as to form a double bedding combination when brought into adjacency.

The foregoing and other various objects and features of this invention will be apparent and fully understood from the following detailed description of the typical preferred forms and applications thereof, throughout which description reference is made to the accompanying drawings.

DESCRIPTION OF THE DRAWINGS

FIG. 6 is an enlarged detailed sectional view taken as indicated by line 6—6 on FIG. 4.

FIG. 7 is a plan view of a second embodiment of the Power Operated Separable Beds and Support Therefor, shown in the secondary separated condition, with the unobstructed floor area therebetween. And, FIG. 8 is an enlarged longitudinal sectional view taken as indicated by line 8—8 on FIG. 7.

PREFERRED EMBODIMENT

Figure 1:
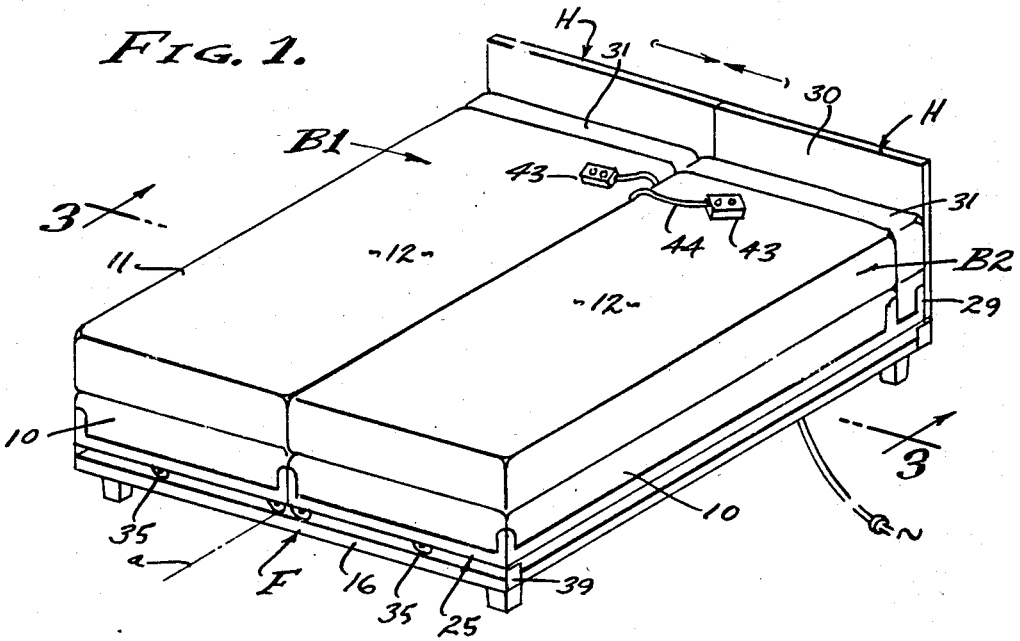
FIG. 1 is a perspective view of the first embodiment Power Operated Separable Beds and Support Therefor shown in the primary double bed condition wherein the two single bed units are juxtaposed adjacently.

Referring now to the drawings, there is the combination of two separable single bed units, one disposed adjacent to the other coextensively along a median line a. The total area of the two single bed units equals or substantially exceeds the area of a usual double spring and mattress unit, and the blanket margins are adapted to be tucked between the springs and mattresses of the two units in the usual manner. As shown in FIG. 1 of the drawings, the single bed units B1 and B2 are alike and preferably identical, each comprising half of the total double bedding combination, being engageable along the median line a that continues from the headboard H to the foot of the mattress combination. Bed sheets and covers are not shown, for clarity in showing the single bed units and their conditioning. As shown, each single bed unit B1 and B2 comprises a rectangular box spring 10 and an overlying mattress 11 of coextensive plan configuration with coplanar sides and ends, and presenting a depressible upper surface 12 upon which occupants are to recline. The construction of the springs and mattresses is conventional, and one or both may be employed as desired, the depth of units B1 and B2 being substantially the same, so that the planar surfaces 12 thereof are coplanar when adjacently brought together.

Figure 2:
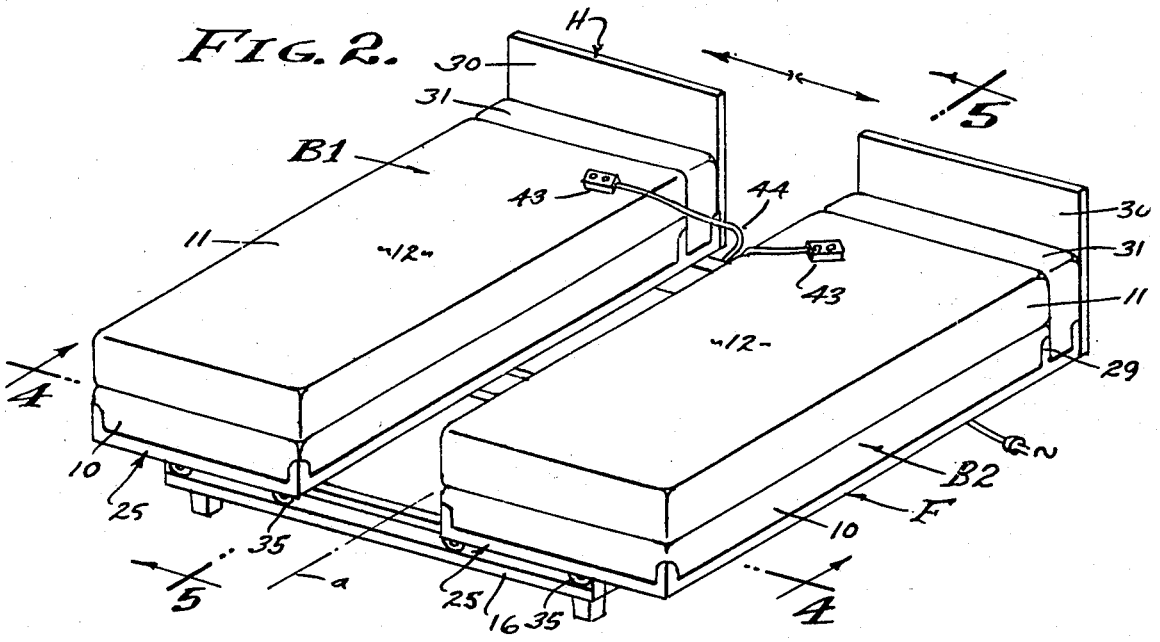
FIG. 2 is a view similar to FIG. 1 showing the secondary single bed condition wherein the two single bed units are separably juxtaposed in parallel relationship.
Figure 3:
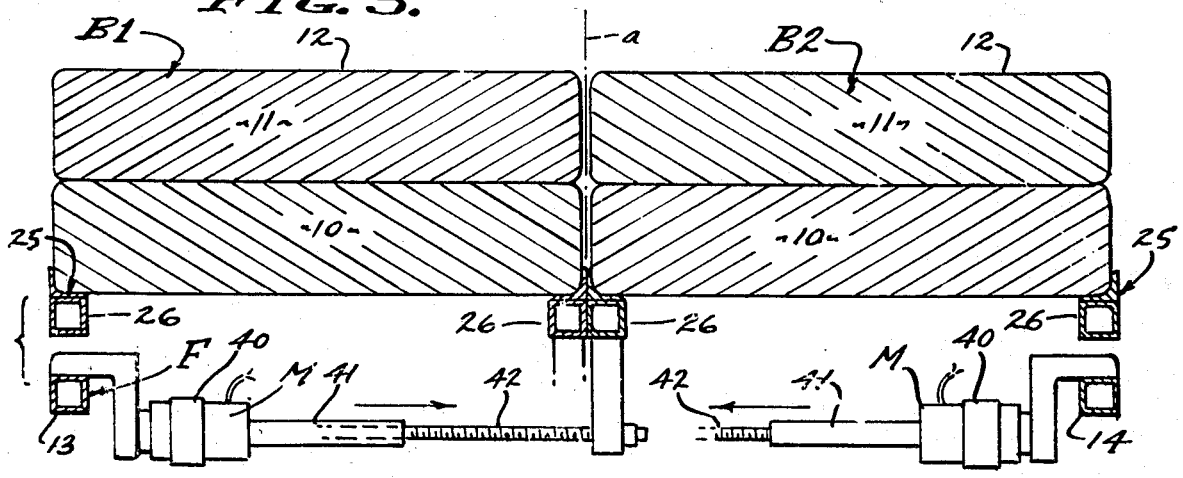
FIG. 3 is an enlarged transverse sectional view taken as indicated by line 3—3 on FIG. 1.
Figure 4:
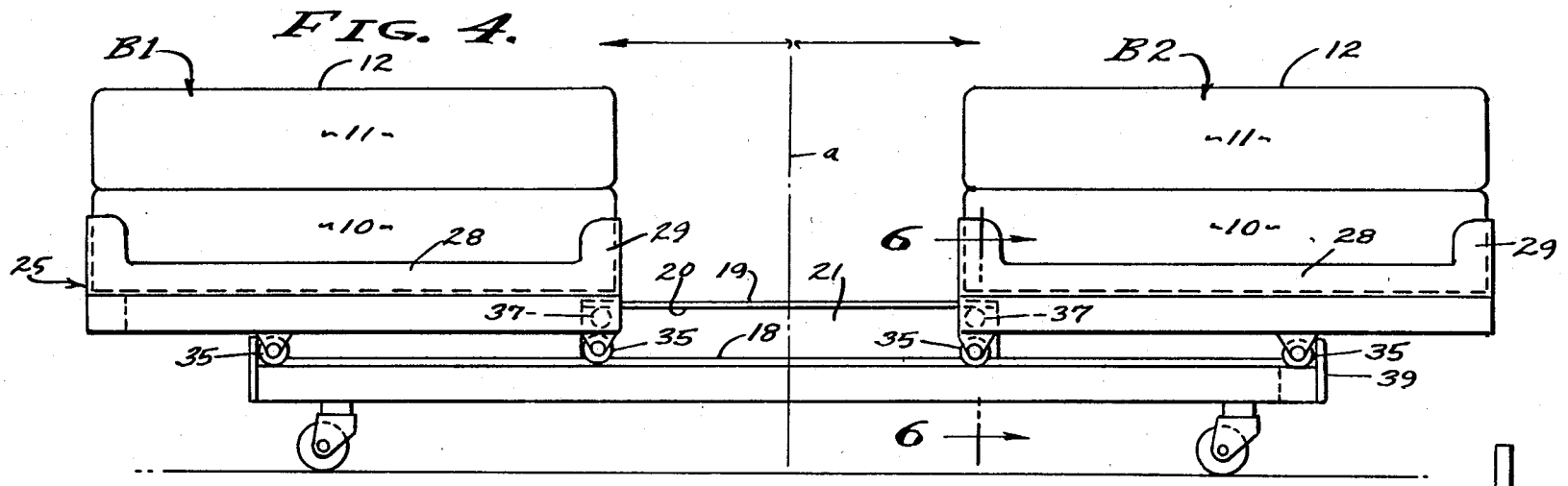
FIG. 4 is an enlarged transverse foot end view taken as indicated by line 4—4 on FIG. 2.
Figure 5:
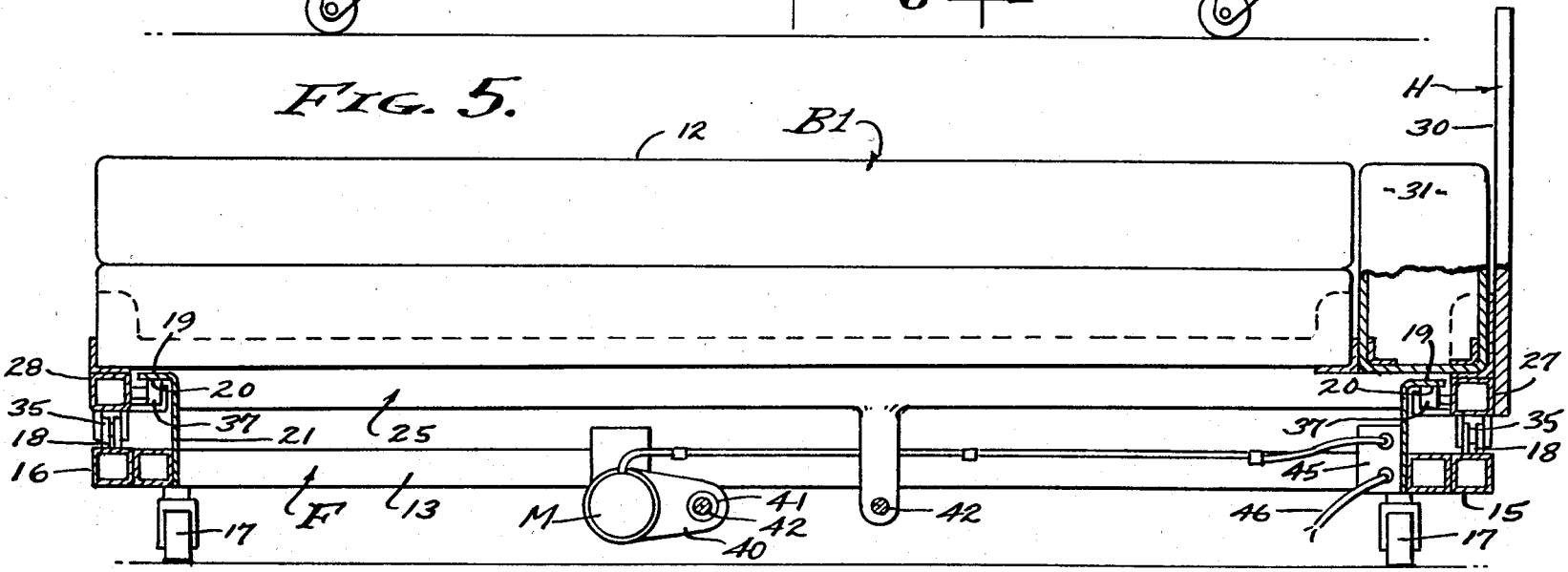
FIG. 5 is an enlarged longitudinal sectional view taken as indicated by line 5—5 on FIG. 2.

The base F is a single structure and is shown in the first embodiment of FIGS. 1 to 6 as a rectangular frame comprised of side rails 13 and 14 joined by a head rail 15 and a foot rail 16. The rails 13–16 are stiff elongated members, preferably of square tube cross section, rigidly joined at right angular corners as by welding or the like. The rails 13–16 are coplanar, in that they are disposed in a common plane above a supporting surface as by legs or by swivel castors 17 as shown. A feature of the frame structure of base F is its supporting track or tracks 18 that guide the single bed units B1 and B2, and its restraining track or tracks 19 that stabilize the single bed units B1 and B2 for cantilevered positioning thereof from the base F. As shown in FIG. 1 the single bed units B1 and B2 are conditioned to be adjacent at the median line a; however as shown in FIG. 2 they are moved into transversely extended cantilevered positions where they are separated and must be stabilized. Accordingly, the head rail 15 is provided with a transversely disposed upwardly face track 18 and an overlying track 19, while the foot rail 16 is provided with the same transversely disposed upwardly faced track 18 and overlying track 19. The head rail and foot rail track constructions can be and are shown as being alike, so that a description of one will suffice for both, as follows:

The base F is a structural frame of a width equal to the combined width of two single bed units B1 and B2 later described. In accordance with this invention, the track 18 extends transversely the full width of the base F between the side rails, and in the form of a straight upstanding rib with a horizontal top face and parallel sides. The track 19 overlies the track 18 and extends transversely away from the median line a, there being a single track member extending through the median line and presenting a flat horizontal bearing face 20 parallel to the top of opposing track 18. As best shown in FIG. 6, the track 19 is carried by a C-shaped shield 21 at the inside of the rail 15 or 16. The track 19 and the supporting shield 21 extend transversely outward from the median line a a distance equal to or slightly greater than the travel of the single bed unit B1 and B2 in their fully separated movement.

The single bed units B1 and B2 are like right and left units, so that a description of one will suffice for both, as follows: Each bedding unit B1 and B2 is comprised of a frame 25 that carries box springs 10 and overlying mattress 11. The frame 25 is structural and of a length and width to receive the single bed unit between side rails 26, and head and foot rails 27 and 28. The rails 26–28 are stiff elongated members, preferably of angle cross section, rigidly joined at right angular corners as by welding or the like. The rails 26–28 are coplanar, in that they are disposed in a common plane next adjacent to and above the plane of the base F, with the end rail or rails over the track or tracks 18. Each single bed unit B1 and B2 overlies half the area of the underlying base F, when the inner rail 26 of the frame 25 is coincidental with the median line a and the outer rail 26 disposed over the rail 13–14. The side flanges of the angle rails are disposed upwardly as shown in order to receive and position the single bed unit, there being angular upstanding corner angles 29 to guide the same. In practice, the single bed units B1 and B2 can be set forward of a head board 30 by means of a positioning rail 27′ that locates a bolster 31 placed between the head board 30 and head end of the single bed unit. The bed unit rail 27 and upstanding corner angles 29 carry the head board 30, as furniture disposed against a bedroom wall (not shown).

In accordance with this invention, each of the two single bed units B1 and B2 has two basic conditions with respect to its positions in relation to the underlying support base F. There is a primary condition of adjacency as shown in FIG. 1, and there is a secondary condition of separation as shown in FIG. 2. Either or both units can be so moved as circumstances require. Accordingly, there is anti-friction support means and guide means between the single bed unit (B1 and B2) and the supporting base F, said means being comprised of the track 18 and supporting guide rollers 35 engaged therewith. The rollers 35 are shown journaled in depending brackets 36 from the frames of the single bed units B1 and B2, although they may be alternately journaled in like brackets projecting upward from the base F. As shown, there is a depending bracket 36 and roller 35 at the inner side of the frame 25, and there is a bracket 36 and roller 35 spaced from the outer side of frame 25 a distance substantially equal to the transverse travel desired. The two bracket and roller installations are aligned with the track or tracks 18, the roller 35 being characterized by double side flanges that embrace the rail 18 to have an opposed guide function. Thus, the single bed units B1 and B2 move rectilinearly in a transverse direction only at a right angle to the median line a.

In accordance with the invention, there is an anit-friction stabilizing means between the single bed unit (B1 and B2) and the restraining track or tracks 19, said means being comprised of restaining rollers 37 engaged with the track or tracks 19. The rollers 37 are shown journaled on offset brackets 38 projecting from the head and/or foot rails 26 and/or 27 of frame 25, to underlie the downwardly faced track 19. As shown, there is an offset bracket 38 and roller 37 at the inner side of the frame 25. This bracket and roller installation is in alignment with the track, or tracks 19, the roller 37 being a simple bearing roller to bear upwardly against track 19 to stabilize the single bed unit B1 and B2 when cantilevered to extend laterally beyond the support of the base F. As shown, there if a stop 39 to limit the lateral movement and separation of each single bed unit, so that the roller or rollers 37 remain engaged beneath the retaining track 19.

In accordance with this invention, there is transport means for positioning the two single bed units in the primary and secondary conditions, as described. In the first form of this invention, the single bed units B1 and B2 are individually motorized to travel between the primary position of adjacency and the secondary positions of separation. The motorization means can vary in form and is preferably a motor driven screw drive which is directly applied to the retilinear motion established by the track 18 and roller 35 relationship above described. As shown, each single bed unit is moved by a reversible electric motor M with a drive mechanism 40 that reversably turns a nut or drive tube 41 into which a transport screw 42 is threadedly engaged. The motor M and drive mechanism 40 are mounted to the base F at one side rail 13–14 and the nut-tube 41 and screw 42 are disposed parallel to track or tracks 18, and with the extended end of the screw 42 anchored to a rail 26 of the frame 25 in each instance; preferably to the inner rail 26 of each frame 25. Individual or simultaneous control of the motor or motors M is by means of separate dual control panels 43 that are portable and accessible to each occupant at the ends of flexible cords 44 carrying the electrical wiring thereof. There is a control box 45 from which the cords 44 extend and to which power is supplied by a cable 46.

From the foregoing it will be seen that a stable bedding unit is provided wherein the base F underlies and supports the selectively moveable single bed units which locate between primary and secondary conditions, converting the bedding unit from a double bed form to a single bed form. The first embodiment hereinabove described employs the integrity of a coextensive underlying base F having support and guide tracks at both the head and foot of the bedding unit, the drive motor M and associated mechanism being disposed intermediate and midway between the foot and head of the unit. The second embodiment shown in FIGS. 7 and 8 employs a headboard base F′ only, with the foot of the two separable single bed units supported upon fixed axis casters 47 that track transversely and are directly engageable with the supporting floor surface. In the event of operation over soft carpeting or the like, a hard surface pad (not shown) is employed for support. The second embodiment motor actuation differs from that first described in its single motor M′ and its installation intermediate the head and foot of the unit at or adjacent the headboard rail 15 and covered by a housing 48 that extends between the single bed units B1 and B2 when they are separated. As shown, the motor M′ is located entirely within the confines of the housing 48, with oppositely projecting drive tubes 41′ to receive the screws 42′ anchored to each of the single bed unit frames 25. A feature of this second embodiment is the unobstructed floor space between the single bed units when they are at all separated.

Having described only the typical preferred forms and applications of our invention, we do not wish to be limited or restricted to the specific details herein set forth, but wish to reserve to ourselves any modifications or variations that may appear to those skilled in the art as set forth with the limits of the following claims.

We claim:

1. A composite bedding unit comprised of two like and adjoining bed units and each having a head rail and foot rail and adapted to be juxtaposed to a median line in a primary double bed condition and to be separated from the median line to a secondary single bed condition, and including;

a transverse horizontally disposed guide track upstanding from a floor supported base at the head rail and extending substantially coextensively beneath the widths of the two single bed units when they are adjacently juxtaposed at the median line in said double bed condition, laterally spaced support rollers carried by the head rail and engageable over the guide track to individually carry the head rail of each of the two single bed units for transverse movement to and away from each other, a transverse downwardly disposed stabilizing track parallel with and overlying a portion of the guide track and extending from the median line a distance less than the extent of the guide track and substantially equal to the travel of the single bed units, each bed unit having at least one stabilizing roller carried at the inner ends of the head rail to engage upwardly against the stabilizing tracks when the bed units are cantilevered, a caster means at the foot rail of each of the two single bed units and engageable with the floor for transverse rolling support directly therewith, and transport means for positioning the two single bed units by transverse movement into either of said primary double bed condition and single bed condition.

2. The composite bedding unit as set forth in claim 1, wherein a stop at the outer end of the guide track individually positions each single bed unit transversely relative to the median line.

3. The composite bedding unit as set forth in claim 1, wherein stops at the opposite outer ends of the guide track simultaneously position the single bed units transversely relative to the median line.

4. The composite bedding unit as set forth in claim 1, wherein the transport means comprises a motor and drive mechanism coupled to each single bed unit individually positioning the singe bed units transversely relative to the median line.

5. The composite bedding unit as set forth in claim 1, wherein the transport means comprises a single motor and drive mechanism coupled to the two single bed units simultaneously positioning the two single bed units transversely relatively to the median line.

6. The composite bedding unit as set forth in claim 1, wherein the stabilizing track has a terminate end in spaced relation to the guide track for reception of an innermost support roller of a single bed unit entered therein.

7. The composite bedding unit as set forth in claim 1, wherein the stabilizing track has opposite terminate ends in spaced relation to the guide track for reception of the innermost support rollers of opposite single bed units entered therein, and wherein stops spaced from the opposite terminate ends of the stabilizing track and at the opposite outer ends of the guide track engage the outermost support rollers and simultaneously position the single bed units in spaced relationship to each other and to the median line.

* * * * *